US005490391A

United States Patent [19]

Hogg et al.

[11] Patent Number: 5,490,391

[45] Date of Patent: Feb. 13, 1996

[54] METHOD AND APPARATUS FOR PRODUCING OXYGEN

[75] Inventors: Neil Hogg, Summit; Joseph Straub, North Haledon, both of N.J.

[73] Assignee: The BOC Group, Inc., New Providence, N.J.

[21] Appl. No.: 295,951

[22] Filed: Aug. 25, 1994

[51] Int. Cl.[6] ..... F25J 3/04

[52] U.S. Cl. ..... 62/38; 62/41; 62/30

[58] Field of Search ..... 62/29, 30, 38, 62/40, 41

[56] References Cited

U.S. PATENT DOCUMENTS

| | | | |
|---|---|---|---|
| 3,813,889 | 6/1974 | Allam et al. | 62/22 |
| 4,022,030 | 5/1977 | Brugerolle | 62/30 |
| 4,717,409 | 1/1988 | Atkinson | 62/22 |
| 4,747,860 | 5/1988 | Atkinson | 62/22 |
| 4,818,262 | 4/1989 | Brugerolle | 62/22 |
| 4,883,517 | 11/1989 | Rathbone | 62/22 |
| 4,916,908 | 4/1990 | Lavin et al. | 62/22 |
| 5,079,923 | 1/1992 | Grenier | 62/22 |
| 5,144,808 | 9/1992 | Ha | 62/24 |
| 5,244,489 | 9/1993 | Grenier | 75/466 |
| 5,291,737 | 3/1994 | Camberlein et al. | 62/22 |

*Primary Examiner*—Christopher Kilner

*Attorney, Agent, or Firm*—David M. Rosenblum; Larry R. Cassett

[57] ABSTRACT

An air separation apparatus and method for producing a gaseous oxygen product at a delivery pressure. A, filtered, compressed and purified air stream is formed and preferably divided into first and second air streams. The air contained within the first air stream is separated by a low temperature rectification process operating in accordance with a Claude cycle to produce liquid oxygen in a lower pressure column with a double column air separation unit. A Claude expander expands at least a major portion of the air contained within the first air stream into the high pressure column. The second air stream is compressed and partially cooled and is then expanded with the performance of work which is in turn applied to the work of compression of the second air stream. Liquid oxygen is pumped from the lower pressure column to substantially the delivery pressure and is vaporized within a mixing column against the second air stream which is also introduced into the mixing column. A liquid stream composed of the liquid produced in the mixing column is then introduced into an intermediate location of the lower pressure column to add the refrigeration of the second air stream to the process.

12 Claims, 1 Drawing Sheet

METHOD AND APPARATUS FOR PRODUCING OXYGEN

BACKGROUND OF THE INVENTION

The present invention relates to a method and apparatus for producing oxygen in which the production is carried out in accordance with a Claude cycle. More particularly the present invention relates to such a method and apparatus in which a gaseous oxygen product is produced at pressure through utilization of a mixing column. Even more particularly, the present invention relates to such a method and apparatus in which part of the refrigeration is supplied from the mixing column to effect a reduction in the required amount of compression.

Air is separated by cooling a filtered, compressed and purified air stream to a temperature suitable for its rectification. The air stream is introduced into a double column air separation unit employing higher and lower pressure columns. The air is rectified in the higher pressure column to produce an oxygen-enriched column bottom and a nitrogen-rich tower overhead. The oxygen-enriched column bottom is further refined in the lower pressure column to produce liquid oxygen as a column bottom and a nitrogen vapor tower overhead. In a Claude cycle, the incoming air stream is compressed to a pressure well above the pressure of the higher pressure column and is turboexpanded prior to its introduction into the higher pressure column. The turboexpansion of the air adds refrigeration to the process in order to compensate for thermodynamic irreversibility of the process, for instance, cold box warm end heat leakages. Moreover, in a Claude cycle excess refrigeration can be supplied to in turn increase liquid production.

If a gaseous oxygen product is to be produced, a stream of the liquid oxygen can be pumped to the delivery pressure. The thus pressurized liquid oxygen stream can be vaporized within the main heat exchanger against the cooling of a portion of the incoming air stream that has been boosted in pressure. Alternatively, an oxygen compressor (at added expense and risk) can be used to compress a product stream at the warm end of the main heat exchanger.

The advantage of the Claude cycle is that a large proportion of the effort involved can be dedicated to the production of liquid oxygen. The disadvantage is that the oxygen production is at the expenditure of the energy required to compress the incoming air stream above the higher pressure column pressure. This problem is exacerbated when a booster compressor is used in connection with vaporizing a liquid oxygen product within the main heat exchanger. As will be discussed, the present invention provides a modification in the Claude process so that a gaseous oxygen product can be produced at pressure with a lower expenditure of energy over a prior art Claude process.

SUMMARY OF THE INVENTION

The present invention provides an air separation method for producing a gaseous oxygen product at a delivery pressure. The air is separated by a low temperature rectification process operating in accordance with a Claude cycle to produce liquid oxygen. The low temperature rectification process includes filtering, compression, and purification stages. A cooling stage is provided to cool the air and a rectification stage employing higher and lower pressure columns connected to one another in a heat transfer relationship is included to produce liquid oxygen as a column bottom of the lower pressure column. Also provided is a Claude expander to expand a major portion of the air into the higher pressure column and with the performance of work. A supplemental refrigerant stream is formed having substantially the delivery pressure. A stream of the liquid oxygen is pumped from the lower pressure column to substantially the delivery pressure. Thereafter, the liquid oxygen is vaporized by introducing the stream of liquid oxygen into a top region of a mixing column and introducing the refrigerant stream into a bottom region of the mixing column, thereby collecting a liquid in the bottom region of the mixing column. A product stream is removed from the top region of the mixing column to form the gaseous oxygen product. A liquid stream composed of the liquid is removed. Such liquid stream is pressure reduced and introduced into an intermediate location of the lower pressure column.

In another aspect, the present invention provides an air separation apparatus for producing a gaseous oxygen product at a delivery pressure. In accordance with this aspect of the present invention, a low temperature rectification means is configured to operate in accordance with a claude cycle. The low temperature rectification means includes filtering, compression and purification means for filtering, compressing and for purifying the air. Also included within the aforementioned means is main heat exchange means configured for cooling the air, rectification means and a Claude expansion means. The rectification means employs higher and lower pressure columns connected to one another in a heat transfer relationship to separate the air, thereby to produce liquid oxygen as a column bottom of the lower pressure column. The Claude expansion means expands at least a major portion of the air into the higher pressure column and with the performance of work. A means is provided for forming a supplemental refrigerant stream having substantially said delivery pressure. A pump is connected to the lower pressure column for pumping a stream of the liquid oxygen from the lower pressure column to substantially the delivery pressure. A mixing column is connected to the pump and the expansion means at top and bottom regions thereof, respectively, for vaporizing the liquid oxygen contained within the stream of the liquid oxygen through direct heat exchange with the second air stream. As a result, a liquid is collected in the bottom region of the mixing column. The mixing column is connected to the main heat exchange means so that a product stream from the top region of the mixing column flows through the mixing column and fully warms to form the gaseous oxygen product. Also a pressure reduction valve is provided in communication with the bottom region of the mixing column and the lower pressure column so that a liquid stream composed of the liquid from the bottom region of the mixing column undergoes a pressure reduction and flows into an intermediate location of the lower pressure column to add refrigeration to the lower pressure column.

It is to be noted that in the mixing column, as in any column, there will be a pressure drop from bottom to top of the mixing column. Therefore, the pressure of the supplemental refrigerant stream used to vaporize the liquid oxygen will have a pressure that will be slightly higher than the liquid oxygen pumped pressure. As used herein and in the claims, the term "substantially" is used to indicate the pressure difference between the supplemental refrigerant stream and the liquid oxygen pumped pressure. Another point is that the term "fully warmed" as used herein and in the claims means warmed to a temperature of the warm end of a main heat exchanger and the term "fully cooled" means cooled to a temperature of the cold end of the main heat exchanger. Obviously "partially warmed" or "partially cooled" would mean warmed or cooled, respectively, to a temperature intermediate the warm and cold ends of the main heat exchanger.

The use of a mixing column to serve as the vaporizer of the stream of the liquid oxygen has known advantages in the art over the use of the main heat exchanger and booster compressor. As mentioned above, in a Claude cycle there is an energy penalty because most of the air must be compressed above the operating pressure range of the higher pressure column. Equipment and energy costs savings are realized in the subject invention by the integration of a mixing column with the air separation plant in which a supplemental refrigerant stream is utilized to both vaporize the product stream and to supply a portion of the required plant refrigeration.

For instance, the refrigerant stream can be formed from a portion of the exhaust of the claude expander to eliminate an oxygen compressor or a booster compressor. Such an embodiment could be used where the oxygen product were required at and below high pressure column pressure. The present invention also comprehends the use of a booster compressor in connection with the formation of the refrigerant stream. Part of the air stream after compression can be boosted in pressure, partially cooled within the main heat exchanger and then expanded by an expander coupled to the booster compressor so that the work of expansion would be applied to the booster compressor. In such an embodiment the refrigeration requirements for the Claude part of the cycle would be reduced which could be realized in an energy savings. A combination of the two embodiments are possible. For instance, when there is a need for liquid production both the booster compressor and Claude expander would be utilized. During periods of low liquid production requirements, the booster compressor could be turned off and the refrigerant stream could then be formed from a portion of the exhaust of the Claude expander.

In a preferred embodiment of the foregoing that utilizes a booster compressor, the Claude expander expands approximately 75% of the air. The expander coupled to the booster compressor produces approximately 40% of the refrigeration utilizing about 23% of the total air. In such case, the Claude expander will produce the additional 60% of the refrigeration. By producing this excess refrigeration in the mixing column, the head pressure in the main air compressor can be lowered. In the foregoing example a head pressure of approximately 9.8 atmospheres absolute produces a 60/40 split of refrigeration between the two expanders. If 100% of the refrigeration had to be produced in a single Claude expansion machine by expanding 100% of the air, the head pressure of the air compressor would have to be increased by approximately 1.5 atmospheres absolute. This in turn would equate to a power difference of approximately 6%. Further power savings in the present invention can be realized by coupling the Claude expander to a generator. Other advantages of the present invention will become apparent in a description of a preferred embodiment in accordance with the present invention.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which the sole FIGURE is a process flow diagram illustrating an apparatus for carrying out a method in accordance with the present invention.

DETAILED DESCRIPTION

Figure 1:
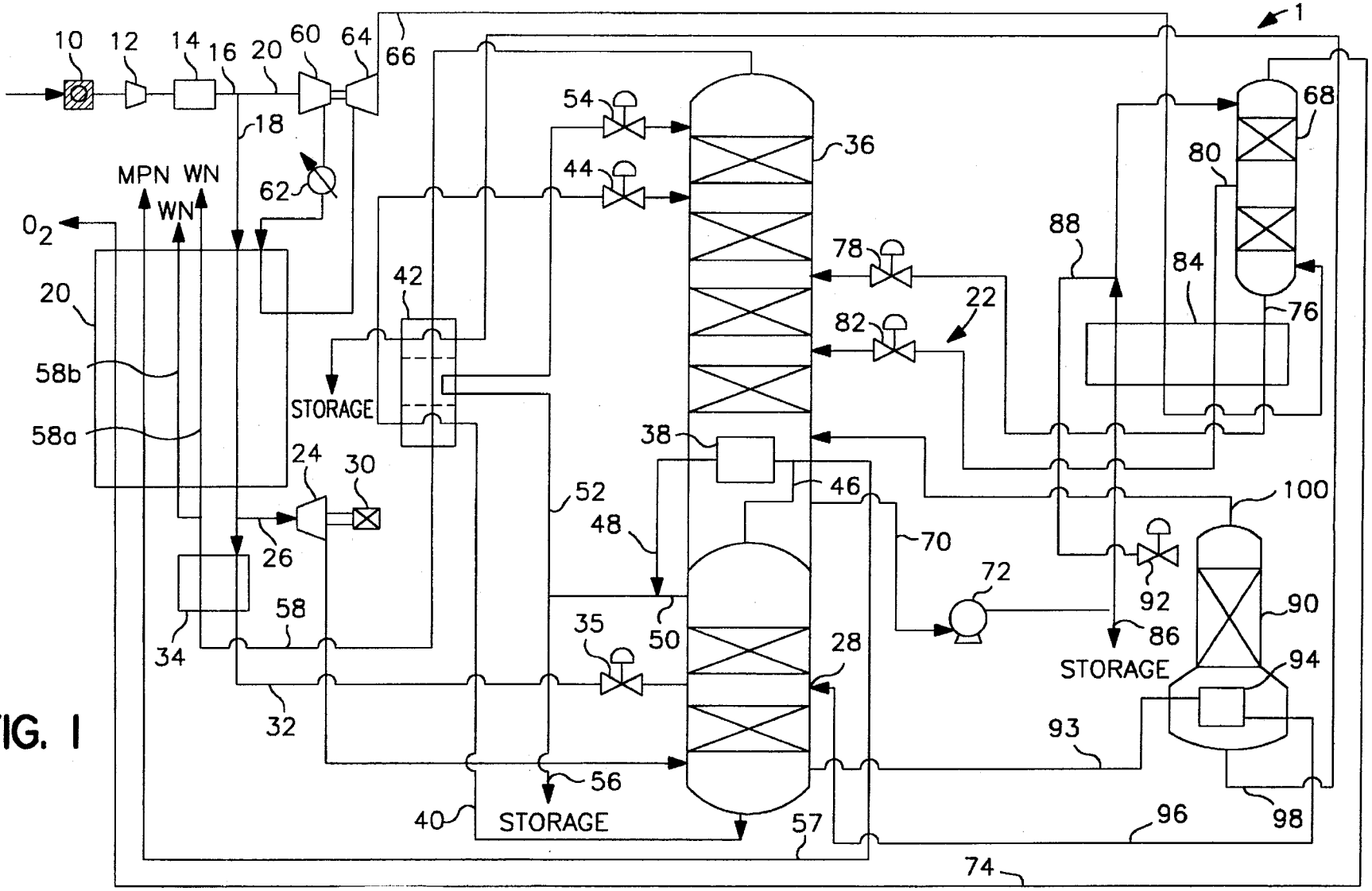

The sole FIG. illustrates a process flow diagram and apparatus 1 in accordance with the present invention. Air after having been filtered by a filter 10 is compressed by a compressor 12 and then purified within a prepurification unit 14. Prepurification unit 14 removes heavy contaminants from the air that would interfere with the air separation process such as carbon dioxide and water. As is known in the art, prepurification unit 14 consists of a series of beds of adsorbent operating out of phase for regeneration purposes.

The thus filtered, compressed and purified air stream 16 is then divided into first and second air streams 18 and 20. The air contained within first air stream 18 is separated by a low temperature rectification process operating in accordance with a Claude cycle. The low temperature rectification process includes a cooling stage formed by a main heat exchanger 20 for cooling the air within first air stream 18 to a temperature suitable for its rectification and air separation unit 22 acts as a rectification stage to rectify the air into components which by and large contain oxygen and nitrogen, respectively. A Claude expander 24 expands at least a major portion 26 of first air stream 18 into a higher pressure column 28 of air separation unit 22. Claude expander 24 can be a turboexpander which is preferably connected to a generator 30 to recover electrical energy for use in the plant, for instance, operating the main air compressor or connected to a product compressor. An optional minor portion 32 of the air is further cooled within a waste heater 34 which serves to pre-warm a waste nitrogen stream to be discussed hereinafter. Major portion 26 is introduced into the bottom region of higher pressure column 28. Minor portion 32 of air stream 18 after being pressure reduced by a pressure reduction valve 35 is also introduced into higher pressure column 28. In a possible alternative embodiment in accordance with the present invention, waste heater 34 could be deleted so that all of first air stream 18 were routed to Claude expander 24.

Air separation unit 22 is also provided with a lower pressure column 36 connected to higher pressure column 28, in a heat transfer relationship by means of a condenser reboiler 38. Both higher and lower pressure columns 28 and 36, respectively, are provided with liquid-vapor contacting elements, such as trays, structured packing, random packing and the like to bring vapor phases of the mixture to be separated into intimate contact with one another. In higher pressure column 28, an oxygen-rich liquid column bottom and a nitrogen-rich vapor tower overhead are produced. A rich liquid stream 40, composed of the oxygen-rich column bottom is then subcooled within a subcooler 42 and pressure reduced to the pressure of lower pressure column 36 by a pressure reduction valve 44. Rich liquid stream 40 is then introduced into lower pressure column 36 for further refinement of the air into liquid oxygen which collects as a column bottom within a lower sump portion of lower pressure column 36 and a nitrogen vapor tower overhead.

The liquid oxygen is vaporized within the sump of lower pressure column 36 against the liquefaction of the nitrogen-rich vapor tower overhead of higher pressure column 28. This is effectuated by extracting a nitrogen-rich vapor stream 46 and condensing said stream within condenser/reboiler 38 to form a liquid reflux stream 48. A first portion 50 of liquid reflux stream 48 is introduced into the top region of higher pressure column 28 for reflux purposes. A second portion 52 of reflux stream 48 is subcooled within subcooler unit 42, pressure reduced by means of a pressure reduction valve 54 to the pressure of lower pressure column 36 and then introduced into a top region of lower pressure column 54. A liquid medium pressure nitrogen stream 56 formed from reflux stream 48 can be extracted and stored. A product medium pressure nitrogen stream 57, formed from part of nitrogen-rich vapor stream 46 can be countercurently passed and fully warmed within main heat exchanger 20.

A waste nitrogen stream 58 is removed from lower pressure column 36 where it partially warms within subcooler unit 42. Waste nitrogen stream 58 is then routed through waste heater 34. Waste heater 34 helps match the temperature profile of the waste nitrogen stream 58 with that of main heat exchanger 20. After passage through waste heater 34, waste nitrogen stream 58 can be split into two partial streams 58*a* and 58*b* which fully warm within main heat exchanger 20 in a countercurrent direction to the incoming air. Partial stream 58*a* can be sent to the water wash system and constitutes most of the flow of waste nitrogen stream 58. Partial stream 58*b* can be used in the regeneration of prepurification unit 14. This division of flow in the waste nitrogen allows main heat exchanger 20 to be designed with a lower overall waste stream pressure drop being that water wash system operates at a lower pressure drop than prepurification unit 14.

Claude expander 24 supplies part of the refrigeration requirements of apparatus 1. The remainder of the refrigeration requirements are supplied by compressing first air stream 20 within a booster compressor 60. After removal of the heat of compression by an aftercooler 62, second air stream 20 is then partially cooled within main heat exchanger 20 and then expanded within a turboexpander 64. Turboexpander 64 performs work of expansion which is applied to booster compressor 60 preferably through a mechanical linkage. The second air stream 20 after turboexpander 64 forms a supplemental refrigerant stream 66.

Supplemental refrigerant stream 66 has a pressure of substantially the delivery pressure that is required for the gaseous oxygen product and is introduced into a mixing column 68. At the same time, a liquid oxygen stream 70 is removed from the bottom of lower pressure column 36 and then pumped by a pump 72 to again substantially a delivery pressure. Liquid oxygen stream 70 after having been pressurized is then introduced into a top region of mixing column 68. The mixing column, which has liquid-vapor contacting elements such as packing, trays, sieve plates and etc., functions as a direct heat exchanger to vaporize the liquid oxygen and to produce a gaseous oxygen product in the top region of mixing column 68. The gaseous oxygen product is removed as a product stream 74, which is then fully warmed within main heat exchanger 20. Liquid oxygen is removed as a liquid stream 76, which after pressure reduction by a pressure reduction valve 78, is introduced into lower pressure column 36 to apply further refrigeration to the process. An intermediate liquid stream 80 can also be removed from the mixing column 68 and introduced into the lower pressure column after pressure reduction in a pressure reduction valve 82 in order to maintain the thermal efficiency of mixing column 68.

Since liquid oxygen stream 70 after having been pumped by pump 72 can be in a subcooled state, liquid oxygen stream 70 is warmed within a subcooling heat exchanger 84 prior to introduction of liquid oxygen stream 70 into mixing column 68 against the cooling of a refrigerant stream 66, liquid refrigerant stream 76 and intermediate liquid stream 80.

A possible operation of apparatus 1 in accordance with the present invention is to turn off booster compressor and turboexpander 64 to make less liquid. To permit such operation, a valved branch line (not illustrated) would have to be provided between Claude expander 24 and the bottom region of mixing column 68 to divert some of the flow from higher pressure column 28 to mixing column 68. The diverted flow would then form an alternate supplemental refrigerant stream during such operation of apparatus 1.

Optionally, a pressurized liquid oxygen stream 86 can be removed prior to subcooling heat exchanger 84 and returned to storage. Also as another option, an auxiliary liquid stream 88 can be removed either before (not shown) or after subcooling heat exchanger 84 and introduced into the top of a high purity scrubbing column 90 which operates at an operation pressure within or greater than the operational pressure range of lower pressure column 36 to permit coupling of high purity scrubbing column 90 to lower pressure column 36. If scrubbing column 90 were operated at high pressures than lower pressure column 36, a pressure reduction valve would have to be provided. Since high purity scrubbing column 90 operates at a pressure below mixing column 68, auxiliary liquid stream 88 is pressure reduced within a pressure reduction valve 92. Reboil is provided by removing a gaseous air stream 93 and condensing the gaseous air contained within a condenser/reboiler 94 located in the bottom of auxiliary high purity scrubber column 90. Liquid stream 96 is returned to the column. As a result, entering liquid is scrubbed by rising vapor to produce a high purity liquid oxygen column bottom which can be extracted as an auxiliary product stream 98. Auxiliary product stream 98 is sent through subcooler 42 and then to storage. The tower overhead is returned as a tower overhead stream 100 to lower pressure column 36.

It will be understood by those skilled in the art although the present invention has been described with reference to a preferred embodiment, numerous changes, additions and omissions can be made without departing from the spirit and scope of the present invention.

We claim:

1. An air separation method for producing a gaseous oxygen product at a delivery pressure:

separating the air by a low temperature rectification process operating in accordance with a Claude cycle to produce liquid oxygen, said low temperature rectification process including filtering, compression and purification stages, a cooling stage to cool said air, a rectification stage employing higher and lower pressure columns connected to one another in a heat transfer relationship to separate the air and thereby produce liquid oxygen as a column bottom of the lower pressure column, and a Claude expander to expand at least a major portion of the air into said higher pressure column and with the performance of work;

forming a supplemental refrigerant stream having substantially said delivery pressure;

pumping a stream of said liquid oxygen from said lower pressure column to substantially said delivery pressure;

vaporizing said liquid oxygen by introducing said stream of said liquid oxygen into a top region of a mixing column and introducing said supplemental refrigerant stream into a bottom region of said mixing column, thereby collecting a liquid in said bottom region of said mixing column;

removing a product stream from the top region of said mixing column to form said gaseous oxygen product; and removing a liquid stream composed of said liquid, pressure reducing said liquid stream, and introducing said liquid stream into an intermediate location of said lower pressure column.

2. The method of claim 1, further comprising:

dividing said air after said compression and purification stages into first and second air streams;

introducing said first air stream into said cooling and rectification stages and said Claude expander so that said at least major portion of the air comprises a major portion of said first air stream;

compressing said second air stream and removing heat of compression from said second air stream;

partially cooling said second air stream within said cooling stage and then expanding said second air stream with the performance of work to substantially said delivery pressure, thereby to form said supplemental refrigerant stream; and applying at least a portion of said work of expansion of said second air stream to the compression of said second air stream, whereby refrigeration to said low temperature rectification process is supplied by both said supplemental refrigerant stream through said liquid stream and said major portion of said first air stream to in turn lower compression requirements for said compression stage.

3. The method of claim 1, further comprising:

diverting part of said stream of said liquid oxygen after having been pumped to a high purity stripping column operating at an operational pressure within an operation pressure range of said lower pressure column;

stripping impurities from said liquid oxygen within said high purity stripping column with a stripper gas produced from boiling up a liquid column bottom produced within said high purity stripping column;

boiling up said liquid column bottom by extracting a gaseous stream having a composition substantially equal to the air from said higher pressure column, liquefying said gaseous stream against vaporizing said liquid column bottom, and introducing a stream of said liquified gaseous stream into said higher pressure column;

extracting a high purity liquid stream from said high purity stripping column composed of said liquid column bottom; and collecting a tower overhead stream from said high purity stripping column and introducing said tower overhead stream into said lower pressure column.

4. The method of claim 2 or claim 3 wherein an intermediate liquid stream is removed from the mixing column, pressure reduced, and introduced into said lower pressure column.

5. The method of claim 4 wherein:

said stream of said liquid oxygen is in a subcooled state after having been pumped; and said second air stream is heat exchanged with said stream of said liquid oxygen, said liquid stream and said intermediate liquid stream so that said stream of said liquid oxygen stream is in a saturated state after said heat exchange.

6. The method of claim 1 or claim 2 or claim 3, further comprising recovering said work of expansion of said Claude expander as electrical energy.

7. An air separation apparatus for producing a gaseous oxygen product at a delivery pressure:

low temperature rectification means configured to operate in accordance with a Claude cycle, said low temperature rectification means including filtering, compression and purification means for filtering, compressing and for purifying said air, main heat exchange means configured for cooling the air, rectification means employing higher and lower pressure columns connected to one another in a heat transfer relationship to separate the air and thereby to produce liquid oxygen as a column bottom of the lower pressure column, and a Claude expansion means for expanding at least a major portion of the air into said higher pressure column and with the performance of work;

means for forming a supplemental refrigerant stream having substantially said delivery pressure;

a pump connected to said lower pressure column for pumping a stream of said liquid oxygen from said lower pressure column to substantially said delivery pressure;

a mixing column connected to said pump and said supplemental refrigerant stream means at top and bottom regions thereof, respectively, for vaporizing said liquid oxygen contained within said stream of said liquid oxygen through direct heat exchange with said supplemental refrigerant stream, thereby collecting a liquid in said bottom region of said mixing column;

the mixing column connected to said main heat exchange means so that a product stream from the top region of said mixing column flows through said heat exchange means and fully warms to form said gaseous oxygen product; and a pressure reduction valve in communication with said bottom region of said mixing column and said lower pressure column so that a liquid stream composed of said liquid from said bottom region of said mixing column undergoes a pressure reductions and flows into an intermediate location of said lower pressure column to add refrigeration to said lower pressure column.

8. The apparatus of claim 7, further comprising:

a booster compressor connected to said purification means so that said air, after purification, is divided into a first and a second air stream and said second air stream is further compressed by said booster compressor;

an after-cooler connecting said booster compressor with said main heat exchange means, said main heat exchange means also configured for partially cooling said second air stream;

expansion means for expanding said second air stream with the performance of work to substantially said delivery pressure, thereby to form said supplemental refrigerant stream;

said expansion means coupled to said booster compressor so that at least a portion of said work of the expansion is applied to the compression of said second air stream, whereby refrigeration to said low temperature rectification process is supplied by both said supplemental refrigerant stream through said liquid stream and said major portion of said air stream to in turn lower compression requirements for said compressed and purified air stream.

9. The air separation apparatus of claim 7, further comprising:

a high purity stripping column operating at an operational pressure within or greater than an operation pressure range of said lower pressure column and connected to said pump so that part of said stream of said liquid oxygen after having been pumped is diverted to said high purity stripping column, said high purity stripping column configured to strip impurities from said liquid oxygen within said high purity stripping column with a stripper gas produced from boiling up a liquid column bottom produced within said high purity stripping column;

heat exchange means operatively associated with said high purity stripping column for vaporizing said liquid column bottom through indirect heat exchange with a gaseous stream having a composition substantially equal to the air from said higher pressure column thereby, liquefying said gaseous stream bottom;

said heat exchange means connected to said higher pressure column so that said gaseous stream circulates from said higher pressure column to said heat exchange means and said gaseous stream after having been liquefied circulates back to said higher pressure column and said high purity stripping column also connected to said lower pressure column so that a tower overhead stream composed of tower overhead of said high purity stripping column circulates into said lower pressure column; and said high purity stripping column having a bottom outlet for extracting a high purity liquid stream from said high purity stripping column composed of said liquid column bottom.

10. The air separation apparatus of claim 8 or 9 wherein said mixing column is connected to said lower pressure column by a pressure reduction valve so that an intermediate liquid stream flows from the mixing column to said lower pressure column.

11. The air separation apparatus of claim 10, wherein said stream of said liquid oxygen is in a subcooled state after having been pumped; and further comprising liquid air subcooler means connected to said pump, said expansion means, and said mixing column for heat exchanging said second air stream with said stream of said liquid oxygen, said liquid stream and said intermediate liquid stream so that said liquid oxygen stream is in a saturated state after said heat exchange.

12. The air separation apparatus of claim 9, further comprising an electrical generator coupled to said Claude expander.

* * * * *